United States Patent [19]

Castille

[11] Patent Number: 4,691,903

[45] Date of Patent: Sep. 8, 1987

[54] HOLDER FOR SMALL PARTS

[76] Inventor: Leopold A. Castille, Rte. 7, Box 17 E15, Opelousas, La. 70570

[21] Appl. No.: 850,705

[22] Filed: Apr. 11, 1986

[51] Int. Cl.[4] ..... B25B 1/00

[52] U.S. Cl. ..... 269/6

[58] Field of Search ..... 81/4, 6–8; 269/3, 6, 234, 237–239, 156; 29/261, 262, 265, 268, 283; 24/251, 249 LS, 248 SA, 248 GC, 248 SB, 248 R, 248 F, 132 HA

[56] References Cited

U.S. PATENT DOCUMENTS

| | | | |
|---|---|---|---|
| 1,141,024 | 6/1915 | Chott . | |
| 1,156,764 | 10/1915 | Druck . | |
| 1,220,423 | 3/1917 | Huisinger et al. | 269/6 |
| 2,854,876 | 10/1958 | Green . | |
| 2,983,036 | 5/1961 | Guard | 269/3 |

*Primary Examiner*—Robert C. Watson

*Attorney, Agent, or Firm*—John F. Sieberth

[57] ABSTRACT

An adjustable small parts holder especially useful in the manufacture or repair of jewelry is described. The device includes a body having at its upper portion two or more moveable jaws. The jaws have inwardly projecting upper end portions and are convergeable toward a common center external to the body. A linear supporting member such as a cylindrical rod is disposed along the longitudinal axis of the body, the upper end portion of this member being moveable upwardly toward the common center. A mechanism such as a rotatable collar is provided for moving the moveable jaws inwardly to cause their inwardly projecting upper end portions to converge toward the common center. In addition, a mechanism such as an adjusting screw is provided so that the upper end portion of the supporting member can be moved toward or away from the common center. It is particularly preferred to provide a cylindrical recess in the upper end portion of the supporting member to accommodate the post of pierced ear type earrings and other parts having a post or like protrusion. Additionally, the inclusion of this recess in the device enables the user to employ of any of a variety of differently shaped auxiliary holding members mounted on posts. In one particularly preferred form, an auxiliary holding member has a bowl-shaped upper surface with a slot extending through the outer wall of the bowl. This form of holder is particularly well suited for securing small pendants, screw-on type earrings, and other objects having an extended portion that may be accommodated by the slot.

7 Claims, 7 Drawing Figures

HOLDER FOR SMALL PARTS

This invention relates generally to an adjustable device for holding small parts. More particularly, this invention relates to an adjustable device for holding earrings and like small items during manufacture or repair.

In accordance with this invention an adjustable holder is provided that is especially useful for securing small items such as pierced ear type earrings, and the like. Thus in one of its embodiments this invention provides a holding device which comprises: (a) a body having a plurality of moveable jaws having inwardly projecting upper end portions convergeable toward a common center external to the body; (b) linear supporting means disposed along the longitudinal axis of the body, the upper end portion of the supporting means being moveable upwardly toward (and downwardly away from) such common center; (c) means for moving the moveable jaws to cause the upper end portions thereof to converge toward such common center; and (d) means for moving the upper end portion of the supporting means toward such common center. In a preferred embodiment the means of (c) is threadably secured to the body and moves the moveable jaws toward the common center when rotated upon the threads in the proper direction. In another preferred embodiment the means of (d) comprises a threaded adjusting screw mechanism for effecting movement of the upper end portion of the means of (b) toward or away from said common center when the adjusting screw is rotated in the proper direction.

While other arrangements are possible, it is preferable that the moveable jaws be pivotally secured to the body at the lower portions of the respective jaws. It is also preferable that these jaws be bowed outwardly along their lengths. It is likewise preferred to utilize as the means of (c) an internally threaded collar threadably secured to the body and adapted, when the collar is rotated upon the threads in the proper direction, to move the jaws inwardly by contact with the bowed outer portions of the jaws. In this way the respective inwardly projecting upper end portions of the jaws are caused to converge toward the aforesaid common center.

In particularly preferred form, the moveable jaws are not only pivotally secured to the body at their lower portions and not only are bowed outwardly along their lengths, but in addition have their respective masses distributed so that when the device is in a vertical position and when the jaws are not constrained by the means of (c), the jaws are pivoted away from each other by the force of gravity.

For holding objects that have a small post or other like protrusion, such as pierced ear type earrings, it is desirable to provide in the upper end portion of the linear supporting means a cylindrical recess extending downwardly along its longitudinal axis.

In another of its preferred embodiments this invention provides a device of the character described in which the body has a hollow tubular configuration, in which the linear supporting means is cylindrical in configuration and is coaxially aligned in the hollow of the body, and in which the means of (d) comprises a threaded adjusting screw mechanism including a knob or headpiece for effecting manual rotation. The matching threads of the adjusting screw mechanism are preferably located in the hollow portion of the body, and the knob or headpiece is preferably disposed below the body. The linear supporting means of (b), and the means of (d) may be separate elements that function in cooperation with each other, or they may be (except for the machine threads of the body) a single integral element.

The above and other features and embodiments of this invention will become still further apparent from the ensuing description, appended claims and figures of the drawing in which:

In the Drawings like numerals represent like parts among the several views.

Figure 1:
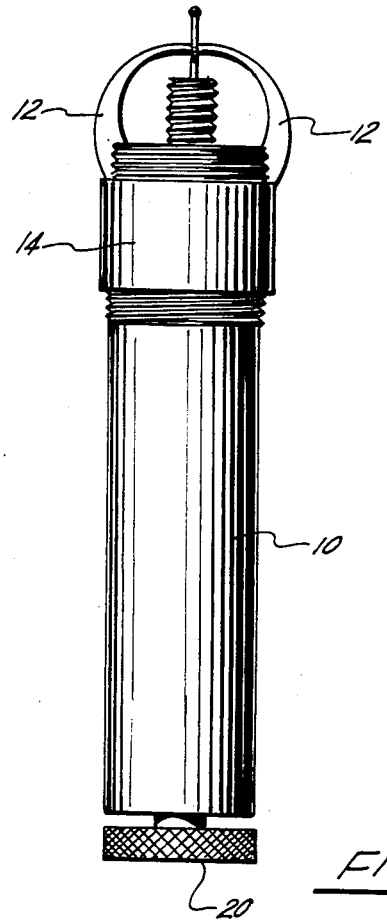
FIG. 1 is a side view of one form of a device of this invention.

In the preferred form depicted in the Drawings the device involves hollow cylindrical body 10, a plurality of jaws 12 pivotally secured to the upper end portion to the body, adjusting nut or collar 14 threadably secured around the upper end portion of the body, cylindrical support 16 extending along the longitudinal axis of the body and concentric therewith, matching machine threads 18 for raising and lowering the position of the the cylindrical support, and an adjusting screw headpiece or knob 20 disposed below the body. In this connection, it will be understood and appreciated that in the specification and claims the terms "upper" and "below" are used merely for the purpose of orientation of the parts relative to each other, and are not to be construed as limitations. In normal use the device will generally be held in upright position as depicted in FIG. 1 and in that position jaws 12 are disposed at the "upper" end portion of the device. However when the small part to be worked on has been secured by jaws 12 and support 16, the device may be held or aligned in any spatial position desired. Thus if the device is held in inverted position one desiring to quibble might say that the jaws at that moment are disposed at the "lower" end portion of the device. But for all purposes hereof the jaws will still be deemed to be disposed at the "upper" end portion of the device.

Body 10, jaws 12, collar 14, support 16, and screw headpiece 20 may be fabricated from any metal, plastic material or other substance having suitable dimensional stability, durability and rigidity.

Body 10 is preferably sized to be held by and in one hand of the user.

Figure 2:
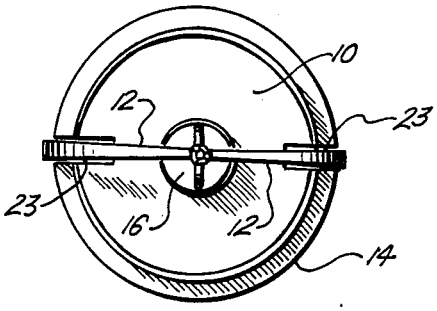
FIG. 2 is a top view of a device of this invention having two jaws pivotally attached to its upper end portion.
Figure 3:
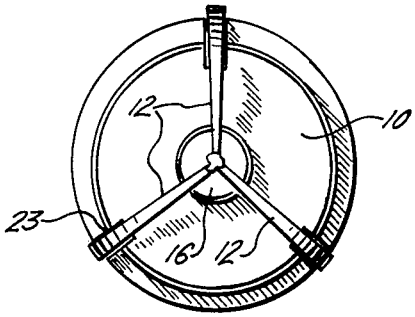
FIG. 3 is a top view of a device of this invention having three jaws pivotally attached to its upper end portion.

The device as depicted in FIGS. 1, 2, 4 and 5 has two jaws 12,12 but as can be seen from FIG. 3 the device may have three or more such jaws. For best results the jaws should be substantially equidistant from each other around the perimeter of the upper portion of body 10.

Thus where there are two jaws, these are preferably disposed at 180 degree intervals from each other (as best seen from FIG. 2). Three jaws are preferably disposed at 120 degree intervals (note FIG. 3), four at 90 degree intervals, and so on. The upper end portion of each jaw projects inwardly so as to grip the piece to be worked on. In the preferred form depicted, each jaw is pivotally secured to body 10 in a vertical slot 23 located in the perimeter of the upper end portion of the body, and the jaws themselves are bowed outwardly, that is, their outer edges are of convex configuration (as shown).

Figure 4:
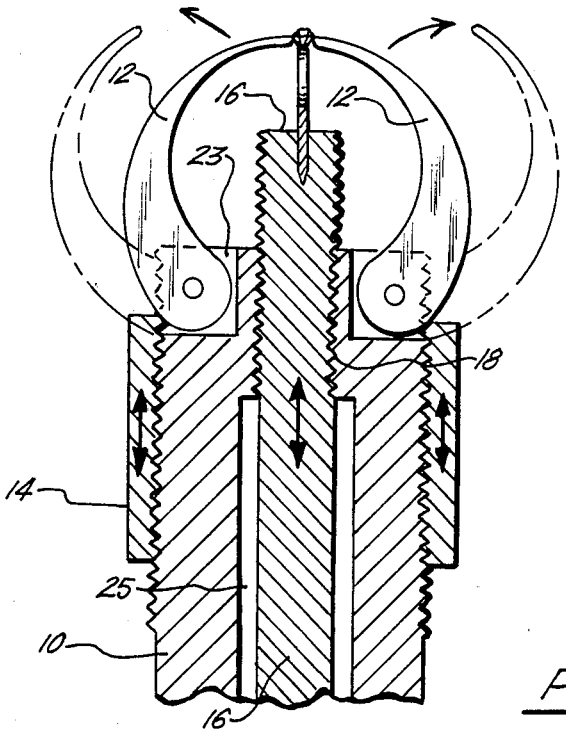
FIG. 4 is a fragmentary vertical section of the upper end portion of the device of FIG. 1.

As best seen in FIG. 4, the interior of collar 14 and the upper exterior portion of body 10 are provided with matching threads, so that the collar may raised or lowered on the body simply by rotating the collar in the proper direction. The exterior of the collar may be knurled or textured to facilitate gripping and manual rotation. It will be understood and appreciated that other modes of securing collar 14 to body 10 may be employed, such as providing a slidable interference fit between them so that the collar may be caused to slide upwardly or downwardly on the body, yet retain any fixed position thereon when not being moved by application of manual force.

Elevation of collar 14 from a position below that shown in FIG. 4 to that shown in FIG. 4 (by rotation, sliding, or the like) causes jaws 12 to be pivoted inwardly from a position such as shown by phantom lines in FIG. 4 toward the longitudinal axis of the body and to a position such as shown in FIG. 4 by virtue of the contact between the collar and the outer bowed surfaces of the jaws 12. Thus the inwardly projecting upper end portions of the jaws converge toward a common center external to (i.e., above) body 10 to contact and grip the piece to be worked on.

In particularly preferred form, jaws 12 are not only pivotally secured to the body at their lower portions and not only are bowed outwardly along their lengths, but in addition have their respective masses distributed so that when the device is in a vertical position and when the jaws are not constrained by collar 14, the jaws are pivoted away from each other by the force of gravity. This is accomplished to shaping each jaw so that its center of gravity is external to (on the outer side of) its pivot point. While not essential to this invention, this construction eliminates the need to move the jaws into the open position manually or by means of springs or the like. Instead, the jaws simply fall open (for example to the position shown by phantom lines in FIG. 4) when the device is held in upright position (and the collar is in a suitable retracted position) whereby the user can confine attention to the manipulations involved in properly positioning the work piece on the device. It will be understood and appreciated however that other ways of opening the jaws (e.g., use of small springs, etc.) can be employed, if desired.

Cylindrical support 16 and the adjusting screw mechanism (e.g., matching threads 18 and adjusting screw knob or headpiece 20) may involve separate parts that work in concert with each other, or they may be in the form of a single unitary element (except for the threads of 18 that are integral with body 10). In either case support 16 is coaxially aligned in body 10 and is adapted to be moved upwardly in the annular cavity 25 of the body by rotation of headpiece 20 in one direction and downwardly in the annular cavity by rotation of the headpiece in the opposite direction. In the form depicted in FIG. 4, threads 18 are located on at least the upper end portion of annular cavity 25 and on at least an upper segment of the exterior of support 16. Preferably, and as depicted in FIGS. 1 and 5, headpiece 20 of the adjusting screw mechanism is axially aligned with the body and is knurled or textured around its perimeter to facilitate manual rotation.

It will of course be understood and appreciated that support 16 and annular cavity 25 may be of matched diameters and threaded along their entire lengths or along only one or more suitable portions of their lengths.

Figure 5:
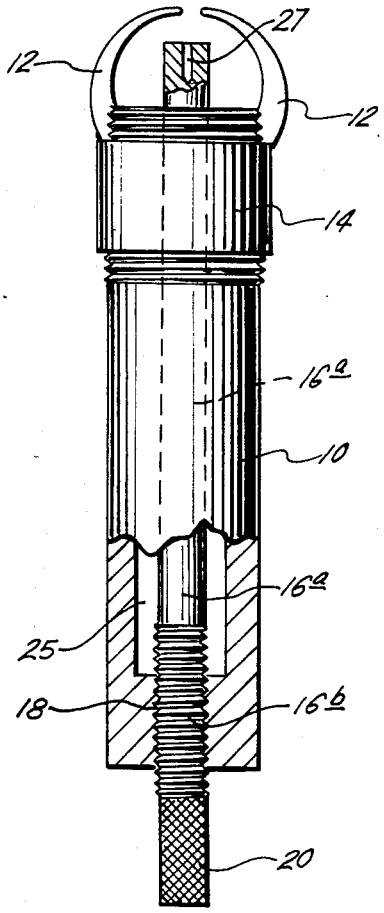
FIG. 5 is a side view partly in section illustrating the device of this invention in another of its forms.

FIG. 5 illustrates a variant of the construction just described. In this embodiment support 16 is divided into an upper segment **16*a* and a separate lower segment 16*b*. Segment 16*a* carries no threads but instead is in the form of a smooth cylindrical rod sized to slidably travel in annular cavity 25. Threads 18 are located on segment 16*b* and on the lower portion of annular cavity 25. Thus rotation of headpiece 20 in one direction causes upward slidable travel of segment 16*a* of support 16, and rotation of headpiece 20 in the other direction allows downward slidable travel of segment 16*a*. Instead of being separate parts, segments 16*a* and 16*b*** may, of course, be integral with each other.

Figure 6:
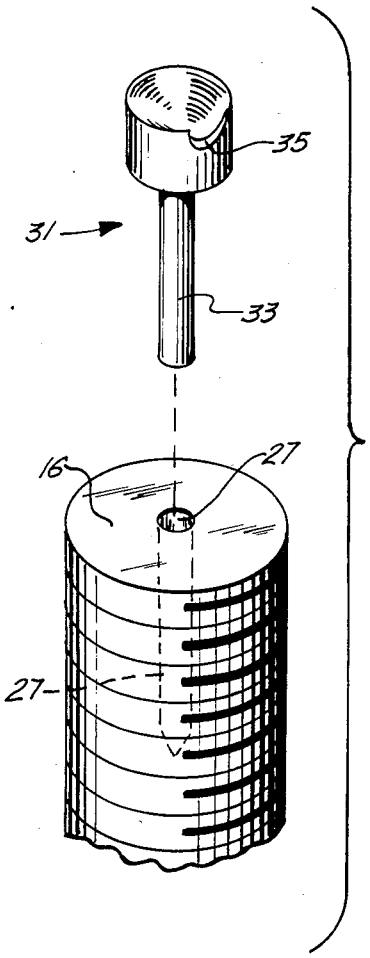
FIG. 6 is an exploded view in perspective of a fragment of the upper portion of the linear supporting means of a device of this invention, and one preferred form of an ancillary holding member which may be employed with the device.
Figure 6A:
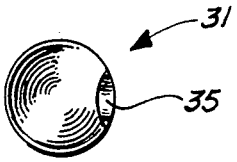
FIG. 6A is a top view of the ancillary holding member depicted in FIG. 6.

Although the upper end of support 16 may have various configurations (e.g., conical, frustoconical, planar, etc.) it is particularly preferred to provide a cylindrical recess 27 coaxially aligned therein. This recess accommodates the post of pierced ear type earrings and other parts having a post or like protrusion. Additionally, and as illustrated by FIG. 6, the inclusion of recess 27 in the device enables the user to make use of any of a variety of differently shaped auxiliary holding members 31 mounted on posts 33. In the particularly preferred form depicted in FIG. 6, holding member 31 has a bowl-shaped upper surface with a slot 35 extending through the outer wall of the bowl. This form of auxiliary holder is particularly well suited for securing small pendants, screw-on type earrings, and other objects having an extended portion that may be accommodated by slot 35. It will be understood and appreciated that a series of interchangeable holders 31 of different sizes and configurations may be provided having, for example, upper holding surfaces that are conical, frustoconical, annularly recessed (the recesses having different diameters from holder to holder), concave, convex, and the like.

By adjusting the position of jaws 12 and the position of support 16, variously sized and shaped small work pieces may be securely held in place by the device. And when the work has been completed, the piece may easily be freed by retracting the jaws or the support, or all of them. It will also be noted that odd shaped items that cannot be conveniently gripped between the tips of the inwardly projecting upper end portions of jaws 12 can be secured in the device by adjusting the jaws to the closed position (where the tips of the inwardly projecting upper end portions of the jaws are in contact with each other or are in close proximity to each other), and moving support 16 upwardly so that the item is sandwiched between the upper end of the support and the overlying bridge formed by the closed jaws.

As this invention is susceptible of considerable variation, the forms and embodiments hereinbefore described being merely illustrative thereof, it is not intended that this invention be limited except within the spirit and scope of the following claims.

What is claimed is:

1. An adjustable small parts holder which comprises:

(a) a cylindrical body having an externally threaded upper portion traversed at equidistant intervals around the perimeter of its uppermost portion by a plurality of radially aligned vertical slots and having an axially aligned hollow channel extending throughout its entire length, at least a portion of said channel being internally threaded;

(b) a plurality of jaws individually disposed in and extending upwardly and outwardly from said slots and pivotally attached therein to said body at the lower portions of the respective jaws, said jaws (i) being bowed outwardly along their lengths and having convex outer surfaces, (ii) having inwardly projecting upper end portions convergeable toward a common center external to and axially aligned with the body, and (iii) having their respective centers of gravity external to the locus of their respective pivotal attachments to the body;

(c) an internally threaded collar threadably secured to the external threaded upper portion of the body and (i) adapted upon rotation in one direction to engage an outwardly bowed convex outer surface portion of each of the jaws and to cause the upper end portions thereof to converge toward said common center, and (ii) adapted upon rotation in the other direction to allow the jaws to pivot away from each other by the force of gravity;

(d) linear supporting means coaxially disposed within and extending throughout the entire length of said hollow channel, the lower portion of the supporting means extending below the body and the uppermost portion of the supporting means extending above the uppermost portion of the body and being adapted to be moved upwardly into close proximity with said common center and alternatively to be moved downwardly away from said common center, at least a portion of the supporting means being externally threaded so as to threadably secure the supporting means to the internally threaded channel of the body; and (e) an adjusting screw knob disposed on the lower portion of the supporting means below the body and (i) adapted upon rotation in one direction to move the uppermost portion of the supporting means into close proximity with said common center, and (ii) adapted upon rotation in the other direction to move the uppermost portion of the supporting means downwardly away from said common center.

2. A device of claim 1 in which the externally threaded upper portion of the cylindrical body is traversed by only two said slots disposed at 180 intervals from each other and in which there is one said jaw disposed in and extending upwardly and outwardly from each of the respective slots and pivotally attached therein in the manner specified in claim 21.

3. A device of claim 1 in which the upper end portion of the linear supporting means has a cylindrical recess extending downwardly along its longitudinal axis.

4. A device of claim 1 in which the supporting means is threadably secured to the internally threaded channel of the body at an upper portion of the body.

5. A device of claim 1 in which the supporting means is threadably secured to the internally threaded channel of the body at a lower portion of the body.

6. In combination, an adjustable small parts holder of claim 3 and an ancillary small parts holding member having a post depending therefrom, said post adapted to be received by the cylindrical recess in the upper end portion of said linear supporting means.

7. The combination of claim 6 wherein the ancillary small parts holding member has a bowl-shaped upper surface with a slot extending through the outer wall of the bowl.

* * * * *

UNITED STATES PATENT AND TRADEMARK OFFICE

CERTIFICATE OF CORRECTION

PATENT NO. : 4,691,903

DATED : SEPTEMBER 8, 1987

INVENTOR(S) : LEOPOLD A. CASTILLE

It is certified that error appears in the above-identified patent and that said Letters Patent is hereby corrected as shown below:

Column 6, line 15 reads "180" and should read -- 180° --.

Column 6, line 19 reads "Claim 21" and should read -- Claim 1 --.

Column 2, line 12, the period, "." should be a semicolon, -- ; --.

Signed and Sealed this

Fifth Day of January, 1988

*Attest:*

*Attesting Officer*

DONALD J. QUIGG

*Commissioner of Patents and Trademarks*